United States Patent [19]

Kern et al.

[11] 4,430,868

[45] Feb. 14, 1984

[54] EVAPORATOR PARTICULARLY SUITABLE FOR AIR CONDITIONERS IN AUTOMOTIVE VEHICLES

[75] Inventors: Josef Kern, Alfdorf; Helmut Bardong, Stuttgart; Bohumil Humpolik, Ludwigsburg, all of Fed. Rep. of Germany

[73] Assignee: Sueddeutsche Kuehlerfabrik Julius Fr. Behr GmbH & Co. KG, Stuttgart, Fed. Rep. of Germany

[21] Appl. No.: 394,876

[22] Filed: Jul. 2, 1982

[30] Foreign Application Priority Data

| | | | |
|---|---|---|---|
| Jul. 8, 1981 | [DE] | Fed. Rep. of Germany | 3126838 |
| Sep. 14, 1981 | [DE] | Fed. Rep. of Germany | 3136374 |
| Dec. 18, 1981 | [DE] | Fed. Rep. of Germany | 3150187 |
| Mar. 16, 1982 | [DE] | Fed. Rep. of Germany | 8207265[U] |

[51] Int. Cl.[3] ..... F25B 39/02

[52] U.S. Cl. ..... 62/515; 62/504; 62/511; 62/525

[58] Field of Search ..... 62/515, 525, 504, 511; 138/40

[56] References Cited

U.S. PATENT DOCUMENTS

| | | | |
|---|---|---|---|
| 2,803,116 | 8/1957 | Tilney | 62/525 |
| 3,563,055 | 2/1971 | Owens | 62/504 |
| 4,244,194 | 1/1981 | Haesters et al. | 62/515 |

FOREIGN PATENT DOCUMENTS 2847525 5/1980 Fed. Rep. of Germany .

*Primary Examiner*—Ronald C. Capossela

*Attorney, Agent, or Firm*—Schwartz, Jeffery, Schwaab, Mack, Blumenthal & Koch

[57] ABSTRACT

Disclosed is an evaporator comprising a connector member, a Venturi distributor connected to the connector member for receiving and distributing a coolant, wherein the Venturi distributor divides the coolant into a plurality of streams, a plurality of channels formed in the connector member for conducting the coolant streams from the Venturi distributor, the channels corresponding in number to the streams with each channel being positioned to receive one of the streams from the Venturi distributor, a plurality of evaporator pipes connected to the connector member in parallel flow arrangement, the pipes corresponding in number to the channels with each pipe being connected to one of the channels, thereby forming a continuous coolant flow path from the Venturi distributor via the channels to the evaporator pipes, and a collection chamber formed in the connector member for receiving the coolant from the pipes. Also disclosed is the use of the evaporator in air conditioners, particularly those of automotive vehicles.

28 Claims, 11 Drawing Figures

EVAPORATOR PARTICULARLY SUITABLE FOR AIR CONDITIONERS IN AUTOMOTIVE VEHICLES

BACKGROUND OF THE INVENTION

The present invention relates to an evaporator, in particular for air conditioners in automotive vehicles.

An evaporator for air conditioners is described in DE-OS No. 28 47 525. The evaporator comprises an evaporator block containing a plurality of bifurcated pipes and cooler baffles, and a connector box or tank. A distributor chamber and a collector chamber are integrated in the connector box. The coolant is introduced by means of a coolant injector into the distributor chamber, flows through the U-shaped bifurcated pipes and is dranw off, after entering the collector chamber, through a compressor suction line.

In an evaporator of this type, all of the evaporator pipes consist of bifurcated pipes, each of which extends into the distributor chamber and into the collector chamber. All bifurcated pipes thus form evaporator pipes installed in parallel. In such a configuration, a uniform distribution of the coolant present in two phases with equal phase proportions in all of the parallel evaporator pipes is only adequately possible when the number of parallel evaporator pipes is very low. In view of capacity values customary in automotive vehicles, this means that the evaporator must be very slender and have very long bifurcated pipes. The structural space required for such a design is usually not available. Becasue the plurality of evaporator pipes are supplied by a common injector and distributor chamber, the cooling effect over the block volume is not uniform, since the flow of the coolant is distributed non-uniformly. This non-uniformity leads to a reduction in the performance of the evaporator.

A coolant flow distributor derived from the Venturi tube is described in U.S. Pat. No. 2,803,116. This distributor consists at its inlet side of a Venturi tube and at its outlet side of a plurality of outlet channels, having individual diameters smaller than the narrowest cross section of the Venturi tube. The outlet channels are arranged symmetrically on a conical surface. They form in the center of the Venturi tube a conical point. In known evaporators, distributor pipes are soldered into the outlet channels of the Venturi distributor and these are connected with the evaporator pipes, with the number of outlet channels corresponding to the number of evaporator pipes, consisting of several bifurcated pipes connected in series. In order to obtain the same flow resistance in all of the inlet pipes, they must be individually bent and aligned, resulting in high costs. The soldering of the bifurcated pipes and the functional testing required by it, are also cost intensive processes.

SUMMARY OF THE INVENTION

It is therefore an object of the present invention to provide an improved evaporator, particularly for use in automative air conditioners.

Another object of the invention resides in providing such an evaporator which is simple in its configuration and economical to manufacture, and whereby a cooling effect uniformly distributed over the evaporator block can be obtained.

In accomplishing the foregoing objectives, there has been provided in accordance with the present invention an evaporator comprising a connector member or box, a Venturi distributor connected to the connector member for receiving and distributing a coolant, wherein the Venturi distributor divides the coolant into a plurality of streams, a plurality of channels formed in the connector member for conducting the coolant streams from the Venturi distributor wherein the number of channels corresponds to the number of streams, with each channel being positioned to receive one of the streams from the Venturi distributor, a plurality of evaporator pipes connected to the connector member in parallel flow arrangement, these pipes corresponding in number to the channels with each pipe being connected to one of the channels, thereby forming a continuous coolant flow path from the Venturi distributor via the channels to the evaporator pipes, and a collection chamber formed in the connector member for receiving the coolant from the pipes.

Further objects, features and advantages of the present invention will become apparent from the detailed description of preferred embodiments which follows, when considered together with the attached figures of drawing.

DETAILED DESCRIPTION OF PREFERRED EMBODIMENTS

Figure 1:
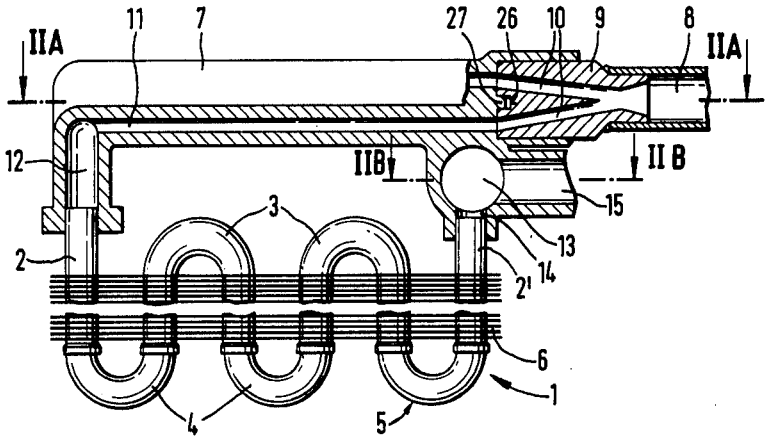
FIG. 1 is a schematic view, in partial secrion, showing the evaporator comprising a connector box designed as a distributor and collector box.

An advantage of the evaporator according to the invention may be found in that the coolant streams, once distributed uniformly, are maintained over the entire length of the pipe, thereby assuring uniform evaporation in all of the pipes, resulting in a high degree of utilization and making possible the optimum dimensioning of the evaporator.

According to a preferred further development of the invention, the Venturi distributor has a number of outlet channels, arranged circularly and corresponding to the number of parallel evaporator pipes. The outlet channels are connected through the conduits with the individual evaporator pipes. In order to assure that the outlet channels of the Venturi distributor always coincide with the channels and to prevent rotation thereof with respect to the channels, the Venturi tube is arranged in an orifice of a housing in a positively secured manner and in such a manner that it cannot rotate.

In order to obtain the simplest arrangement of the connector box saving the most space, it is advantageous to arrange the channels between the Venturi distributor and the evaporator pipes radially and to terminate each of them in a connector fitting, to provide the collector chamber with a plurality of connector fittings and to fasten the evaporator pipes in the connector fittings in a coolant tight manner.

If for design reasons the channels are of different lengths and it is nevertheless desired that the same pressure drop be achieved in each, it is advantageous to provide the longer channels with a larger diameter than the shorter ones. In order to eliminate interfering effects in the collector chamber which appear as a function of the layout of the compressor suction line, the differential velocity profile in the collector chamber is compensated by adapting the diameters of the channels.

To further simplify the assembly with respect to production and to reduce the weight, it is advantageous to manufacture the connector box in two parts, wherein one part is laid out as the distributor box receiving the body with the channels and the other part as the collector box.

The fastening and sealing of the Venturi distributor can be effected in different ways. For a releasable connection, it is proposed that the Venturi distributor be fastened to the connector box by means of the beading or crimping of tabs or by means of a hollow threaded bolt and sealed with an annular gasket. A simple, nonreleasable fastening of the Venturi distributor in the connector box, wherein no gasket is required, consists of adhesively bonding the Venturi distributor in the connector box. For this purpose, the Venturi distributor has a circumferential configuration to accommodate the needs of adhesive bonding technology. This may consist of a plurality of grooves extending in the circumferential direction or of knurling. The cavities formed by the grooves or the knurling accept the adhesive which effects the bonding and sealing. In the simplest possible configuration of the connector box, each of the evaporator pipes is fastened to the connector box at its beginning and at its end only. For this purpose, preferably each of the evaporator pipes consists of several bifurcations interconnected by pipe bends or elbows.

In order to eliminate connection of the bifurcated pipes by means of separate pipe elbows, it is advantageous to provide reversing channels in the connector box, whereby each of the reversing channels connects together two bifurcated pipes. For manufacturing reasons, the arrangement of reversing channels in single piece connector boxes is hardly possible. It is therefore of advantage to provide a two-part connector box, comprising a cover part and a bottom part, with the parting plane extending between the connector fittings and the reversing channels. This obviously requires a large joining surface between the cover part and the bottom part. The present invention also sets forth measures to increase the rigidity and tightness of the joint of the cover part and the bottom part.

It for some reason a multiple part connector box with large joining surfaces is undesirable, it is advantageous to provide a plurality of orifices in the connector box, arranged below the channels and transversely to them, with these orifices serving to receive the fingers of an insert. The reversing channels are located on the side of the fingers facing the connector fittings, with two connector fittings opening into the orifices in the area of each reversing channel. Measures to close the orifices by suitable means for the fastening and sealing of the insert are set forth in the detailed description below.

Numerous factors must be considered in the slection of material. Thus, it must be ascertained whether the material is impermeable to the coolant, i.e., in particular, fluorinated hydrocarbons must not diffuse through it. The workability, the price and the weight of the material are also of importance. For this reason, the connector box preferably consists of a fiber-reinforced polyamide or of aluminum. To prevent the diffusion of the coolant through the material, the connector box may be clad and/or jacketed with a layer of a material impermeable to the coolant.

Exemplary embodiments of the evaporator according to the invention are explained in detail hereinafter with reference to the drawings.

In FIG. 1 an evaporator is shown schematically. The evaporator comprises a plurality of evaporator pipes 5 consisting of the pipes 2, 2', bifurcated pipes 3 and pipe elbows 4, and the cooling fins 6 arranged transversely to the pipes 2 and bifurcated pipes 3. The pipes 2 in each case form the beginning and the end of the evaporator pipes 5 and are mounted in a distributor and collector box, designated hereafter as the connector box 7.

The connector box 7 has a coolant inlet 8, connected to the inlet side of a Venturi distributor 9. The Venturi distributor 9 has a plurality of outlet channels 10, with one outlet channel 10 provided for each evaporator pipe 5. The outlet channels 10 open into the channels 11, each of which is connected with one of the evaporator pipes 5 through a connector fitting 12 which receives a pipe 2.

In order to insure that the outlet channels 10 coincide with the channels 11, a recess 26 in the form of a rectangular on elongated hole is provided in the front side of the Venturi distributor 9 as security against rotation. This recess is engaged by a suitable projection 27 of the connector box 7, and a positive joint is thereby obtained. The pipe 2', forming the other end of the evaporator pipe 5, is secured in a connector fitting 14 and opens into a tubular collector chamber 13. The collector chamber 13 is connected with a compressor suction line 15.

Figure 2:
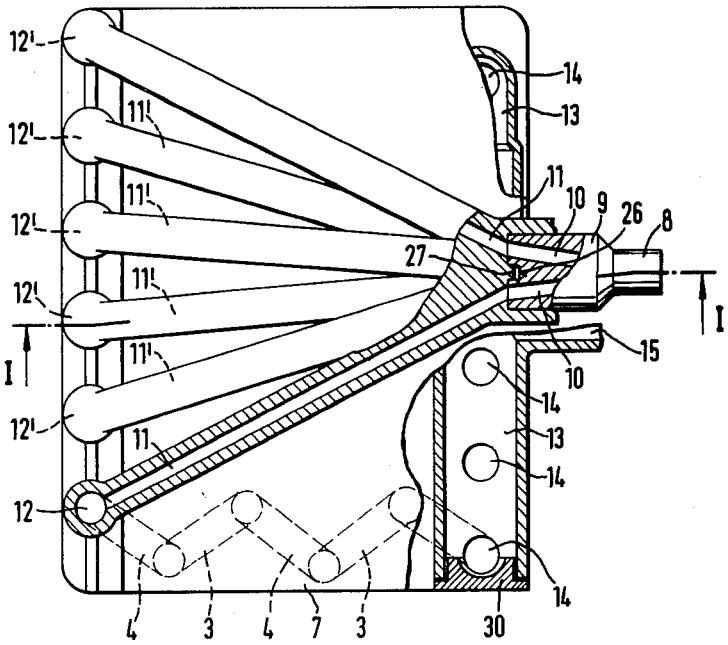
FIG. 2 is a top view in partial section of a connector box, taken along the line IIA—IIA and the line IIB—IIB in FIG. 1.

In FIG. 2 the connector box 7 is shown in part in a top view and in part in a cross section along the lines IIA—IIA and IIB—IIB in FIG. 1. Through the section IIB—IIB, the collector chamber 13, together with the connector fitting 14 and the compressor suction line 15, may be seen on the right-hand side. The collector chamber 13 is equipped with a closure piece 30, which may be adhesively bonded into the end of the cylindrical collector chamber 13. The section IIA—IIA shows two outlet channels 10, opening into the channels 11 associated with them. The channels which are not shown in section are designated 11', and the connector fittings belonging to them are designated 12'. It is seen from this representation that the channels 11 and 11' are arraged radially from the Venturi distributor 9.

In the lower part of FIG. 2, the arrangement of the bifurcated pipes 3 and the pipe elbows 4, hidden by the connector box 7, is indicated by the broken lines. The layout of all of the other evaporator pipes is similar;

they are not shown for the sake of clarity. Reference numbers are in agreement with those of FIG. 1. The section along the line I—I corresponds to the view shown in FIG. 1.

Figure 3:
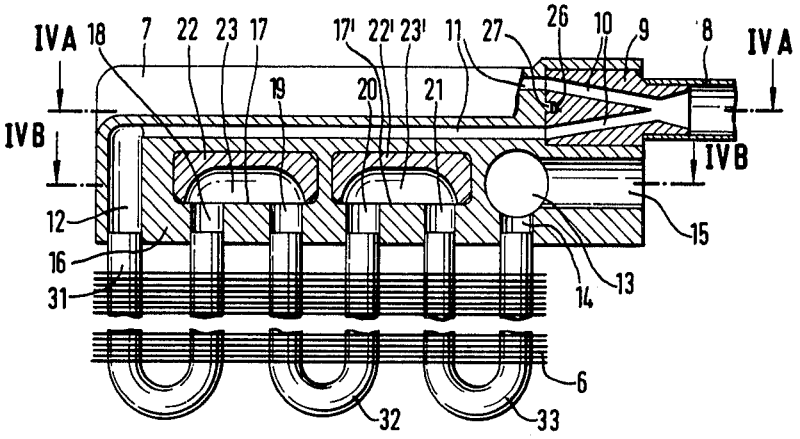
FIG. 3 is a partial cross-sectional view of a connector box with integrated reversing channels.

A connector box 7 is shown in FIG. 3; it is essentially in agreement with that of FIG. 1. Reference numbers for similar parts are the same as those of FIG. 1. In contrast to the arrangement according to FIG. 1, the connector box 7 in FIG. 3 is formed underneath the channel 11 between the connector fitting 12 and the collector chamber 13 in the shape of a block 16, wherein two orifices 17, 17' are provided, transversely to the channels 11 and parallel to each other. Several connector fittings 18, 19, 20, 21 open into these orifices 17, 17', with the number and arrangement of said connector fittings being explained hereinafter in relation to FIG. 4.

An evaporator block 1 is shown schematically under the connector box 7; it consists of the bifurcated pipes 31, 32, 33 and the cooling fins 6 arranged perpendicularly to the bifurcated pipes. The bifurcated pipe 31 is fastened on one end in the connector fitting 12 and on the other end in the connector fitting 18. The bifurcated pipe 32 leads from the connector fitting 19 to the fitting 20, and the bifurcated pipe 33 opens into the fittings 21 and 14.

The fingers 22, 22' of an insert 24 are located in the orifices 17, 17'. On their side facing the connector fittings 18, 19, 20, 21, the fingers 22, 22' contain the reversing channels 23, 23', the latter being arranged so that each reversing channel 23, 23' connects two connector fittings 18 and 19 or 20 and 21 and thus also two bifurcated pipes 31 and 32 or 32 and 33. The bifurcated pipes 31, 32, 33 thus form with the reversing channels 23, 23' an evaporator pipe beginning in the connector fitting 12 and ending in the collector chamber 13.

Figure 4:
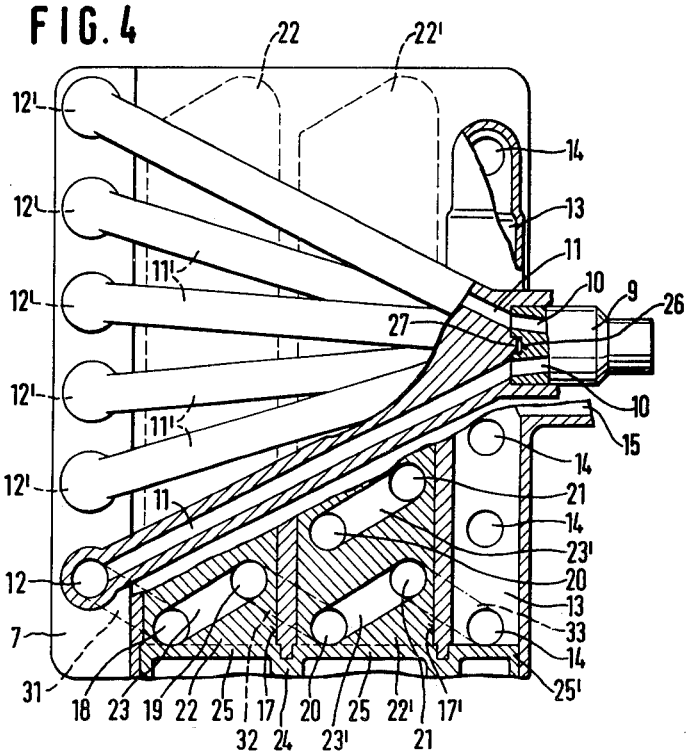
FIG. 4 is a top view in partial section of a connector box, taken along the line IVA—IVA and the line IVB—IVB in FIG. 3.

In FIG. 4, the connector box 7 is represented in part in a top view and in part in a cross section along the lines IVA—IVA and IVB—IVB of FIG. 3. To the extent that the parts are those of the preceding figures, they are provided with the same reference numbers. In the lower part of FIG. 4 on the right-hand side, the collector chamber 13, together with the connector fittings 14 and the compressor suction line 15, are rendered visible by the section IVB—IVB. The orifices 17, 17' extend parallel to the collector chamber 13; they receive the fingers 22, 22' of an insert 24. The insert 24 has a socket 25, 25' carrying the fingers 22, 22' and simultaneously serving to close off the orifices 17, 17' and the collector chamber 13.

Known methods used for the fastening and sealing of the cabinets of heating or air conditioning installations may be employed to seal the insert 24. Fastening is effected—depending on the material of the box—for example, by means of bolts, rivets or clamps, or by beading, caulking or adhesive bonding. Sealing may be obtained, for example, by using a gasket, a sealing plate or an adhesive. A tongue-and-groove joint of the socket 25 and the connector box 7 is particularly suitable for the adhesive bonding of the insert 24.

The reversing channels 23 and 23' are arranged in the fingers 22, 22' and establish connections between the connector fittings 18 and 19 and 20 and 21, respectively. The bifurcated pipes 31, 32 and 33 are indicated by broken lines; together with the reversing channels 23 and 23', they form an evaporator pipe leading from the connector fitting 12 to the collector chamber 13. The configuration of all other evaporator pipes, leading in each case from a connector fitting 12' to the collector chamber 13, is similar.

The section IVA—IVA shows two outlet channels 10, opening into channels coordinated with them. The channels which are not shown in section are designated 11', and the associated connector fittings are designated 12'. It is seen in FIG. 4, as previously in FIG. 2, that the channels 11, leading to the outer connector fittings 12, 12', are longer than those leading to the center fittings 12'. In order to obtain the same pressure drop in all of the channels 11, 11', the different lengths may be compensated for by the suitable selection of the diameter, i.e., the longer channels are made slightly larger in diameter and the shorter channels slightly smaller.

Broken lines in the upper part of FIG. 4 show how the fingers 22 and 22' extend close to the opposite side of the connector box 7.

Figure 5:
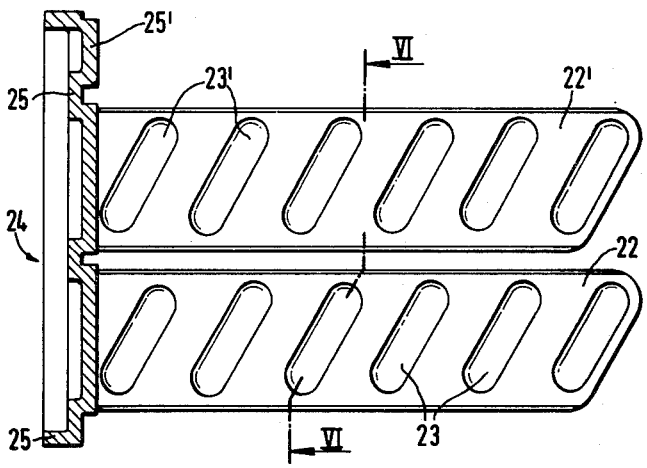
FIG. 5 illustrates an insert containing the reversing channels of FIG. 4.

FIG. 5 displays the insert 24, consisting of the socket 25, 25' and the fingers 22 and 22' mounted upon it. The part 25' of the socket 25 is designed as the close-off piece of the collector chamber 13 and is therefore adapted to the diameter of the cylindrical collector chamber 13. The upper finger 22' has six reversing channels 23'. Similarly, six reversing channels 23 are provided in the lower finger 22. The arrangement of the reversing channels 23, 23' with respect to their length and position is governed by the arrangement of the connector fittings 18 to 21, which are to be connected by them.

Figure 6:
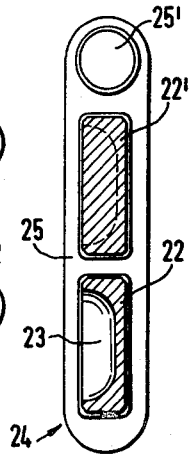
FIG. 6 is a cross-sectional view through the insert taken along line VI—VI in FIG. 5.

FIG. 6 shows a section through the insert 24 along the line VI—VI in FIG. 5. The reference symbols of the individual parts are identical with those of FIG. 5. The finger 22 is sectioned in the area of the reversing channel 23 and the finger 22' in the area between two reversing channels 23'.

Figure 7:
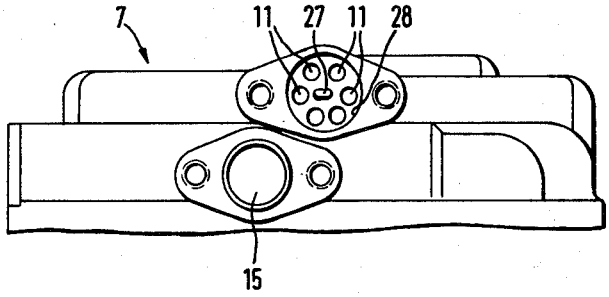
FIG. 7 is a lateral elevational view of the connector box shown in FIGS. 1 and 3.

FIG. 7 shows a lateral elevation of the connector box 7, on the side where the inlet and the outlet for the coolant are located. On this side, a housing orifice 28 is visible, serving to receive the Venturi distributor 9 shown in FIGS. 1-4. At the bottom of the housing orifice 28, six channels 11 are arranged in a circle so that the nozzle orifices 10 of the Venturi distributor open into the channels 11. The projection 27, having an elongated shape, serves as security against rotation of the Venturi distributor vis-a-vis the channels 11.

Figure 8:
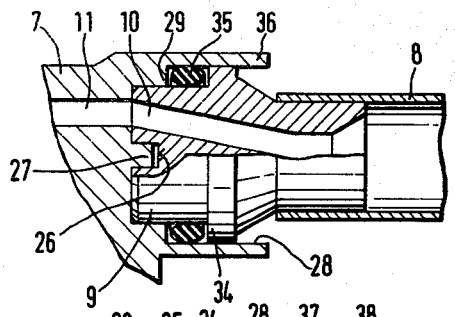
FIG. 8 is a cross-sectional view of the layout and sealing of a Venturi distributor in the connector box.

FIG. 8 shows a first example of the fastening and sealing of the Venturi distributor 9 in the connector box 7. The Venturi distributor 9 is built into the orifice 28 of the connector box 7, wherein between a step 29 on the connector box 7 and a step 34 of the body of the Venturi distributor 9, an annular gasket 35 is inserted. The connector box 7 has a plurality of tabs 36 at the outer end of the orifice 28, distributed over its circumference, and these are beaded or crimped to fasten the Venturi distributor 9. For the rest, the reference symbols and layouts are identical with those described with regard to preceding figures.

Figure 9:
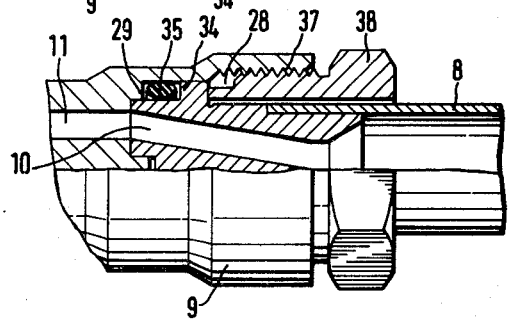
FIG. 9 is a cross-sectional view illustrating a variant of the embodiment of FIG. 8.

FIG. 9 displays a further embodiment of the mounting of the Venturi distributor 9 in the connector box 7. In contrast to the arrangement in FIG. 8, the housing orifice 28 is provided on its outer area with threads 37. A hollow bolt 38, having in its bore a section with a smaller diameter than that of the Venturi distributor 9, is screwed into the threading 37, thus pressing the Venturi distributor 9 against the gasket seat. For the rest, the reference symbols are those of FIG. 8 and are therefore not repeated here.

Figure 10:
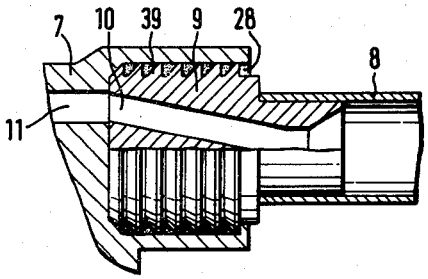
FIG. 10 is a cross-sectional view illustrating a Venturi distributor sealed by fastening means.

FIG. 10 shows a Venturi distributor 9, having on its circumference a plurality of grooves 39, extending to the circumferential direction. In this manner, cavities are formed between the wall of the orifice 28 and the body of the Venturi distributor 9, into which an adhesive is introduced during the installation. The adhesive serves to fasten and seal the Venturi distributor in the connector box 7. In place of grooves 39, the circumferential surface of the Venturi distributor 9 may be knurled.

Figure 11:
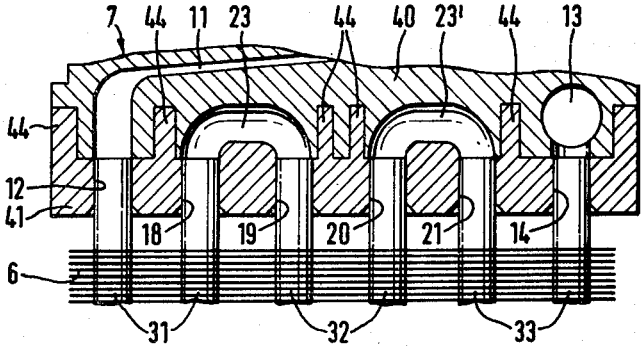
FIG. 11 is a cross-sectional view illustrating a part of a connector box in two parts.

FIG. 11 represents a two-part connector box, similar to that in FIG. 3 and consisting of a cover part 40 and a bottom part 41. In the cover part 40, the channels 11, the collector chamber 13 and the reversing channels 23, 23' are arranged. In the bottom part 41, which contains the connector fittings 12, 14 and 18–21, the bifurcated pipes 31, 32 and 33, are mounted.

The parting plane of the connector box 7 extends between the reversing channels 23, 23' of the cover part 40 and the connector fittings 12, 14, 18–21 of the bottom part 41, with the projections 44 being provided on the bottom part 41 to engage the corresponding recesses of the cover part 40, thus increasing the strength and tightness of the joint between the two parts. The projections 44 and the corresponding recesses may be in the form of a tongue-and-groove joint, essentially as described in DE-OS No. 28 47 525, the disclosure of which is herein incorporated by reference.

Naturally, it is also possible to design the connector box 7 with several parts or to place the parting plane differently in case of a two-part layout. In this manner, different requirements, for example, concerning the simplicity of installation or the suitability of manufacturing tools, are necessitated.

What is claimed is:

1. An evaporator, comprising:

a connector member;

a Venturi distributor connected to said connector member for receiving and distributing a coolant, wherein said Venturi distributor divides said coolant into a plurality of streams;

a plurality of channels formed in said connector member for conducting the coolant streams from said Venturi distributor, said channels corresponding in number to said streams with each channel being positioned to receive one of said streams from said Venturi distributor;

a plurality of evaporator pipes connected to said connector member in parallel flow arrangement, said pipes corresponding in number to said channels with each pipe being connected to one of said channels, thereby forming a continuous coolant flow path from said Venturi distributor via said channels to said evaporator pipes; and a collection chamber formed in said connector member for receiving said coolant from said pipes.

2. An evaporator according to claim 1, wherein said Venturi distributor comprises a plurality of outlet channels, arranged in a uniform distribution on a conical surface of said Venturi distributor, the number of said outlet channels corresponds to the number of said channels opening into said evaporator pipes.

3. An evaporator according to claim 1, wherein said Venturi distributor is located in a housing orifice in said connector member, said housing orifice including means for preventing rotation of said Venturi distributor.

4. An evaporator according to claim 3, wherein said housing orifice comprises means for fastening said Venturi distributor to said connector member and means for sealing said Venturi distributor.

5. An evaporator according to claim 4, wherein said sealing means comprises a gasket.

6. An evaporator according to claim 5, wherein said fastening means comprises the beading of a plurality of tabs.

7. An evaporator according to claim 5, wherein said fastening means comprises a hollow bolt.

8. An evaporator according to claim 1, wherein said channels are radially arranged in regard to said Venturi distributor.

9. An evaporator according to claim 1, further comprising a plurality of connector fittings for connecting said channels to said evaporator pipes.

10. An evaporator according to claim 9, wherein all of said channels leading from said Venturi distributor to said connector fittings are of equal length and have the same cross-sectional area.

11. An evaporator according to claim 9, wherein said channels are of different lengths and wherein the longer channels have sufficiently larger diameters than the shorter channels to provide for an equal pressure drop over all of the channels.

12. An evaporator according to claim 1, further comprising a compressor suction line, said suction line opening into said collection chamber for removing said coolant from said chamber.

13. An evaporator according to claim 12, wherein the diameters of said channels vary depending upon the interfering effects created by said compressor suction line.

14. An evaporator according to claim 1, wherein said Venturi distributor is provided on its circumferential surface with a plurality of grooves extending in the circumferential direction and wherein said Venturi distributor is fastened and sealed in said connector box by means of adhesive bonding.

15. An evaporator according to claim 1, wherein said Venturi distributor is provided on its circumferential surface with a plurality of knurls extending in the circumferential direction and wherein said Venturi distributor is fastened and sealed in said connector box by means of adhesive bonding.

16. An evaporator according to claim 1, wherein each of said evaporator pipes comprises a bifurcated pipe, interconnected by means of bent pipe sections.

17. An evaporator according to claim 5, further comprising a plurality of reversing channels for connecting two evaporator pipes formed in said connector member between said connector fittings and a plurality of intermediate connector fittings opening into said reversing channels to receive said evaporator pipes.

18. An evaporator according to claim 17, wherein said connecting member comprises a plurality of openings extending between said connector fittings, and said evaporator further comprises an insert having a plurality of fingers, with one finger being inserted into each of said orifices, wherein said reversing channels are formed in said fingers, and wherein said orifices and said collection chamber comprise blind holes entering on the same side of said connecting member and said insert further comprises a closure member for closing each of said orifices and also said collection chamber against loss of coolant.

19. An evaporator according to claim 18, wherein said insert is fastened in said connector member and is sealed by means selected from a gasket or an adhesive.

20. An evaporator according to claim 17, wherein said connector member comprises a cover part and a bottom part, wherein the parting plane formed between said parts extends between said connector fittings and said reversing channels.

21. An evaporator according to claim 20, wherein said cover part and said bottom part on their joining surfaces comprise projections and recesses in engagement with each other.

22. An evaporator according to claim 21, wherein said projections and said recesses comprise a tongue-in-groove joint.

23. An evaporator according to claim 1, wherein said connector member comprises a synthetic resinous material.

24. An evaporator according to claim 23, wherein said synthetic resinous material comprises a fiber reinforced polyamide.

25. An evaporator according to claim 23, wherein said connector member is clad or jacketed with a layer of a material impermeable to the coolant.

26. An evaporator according to claim 1, wherein said connector member comprises a metal.

27. An evaporator according to claim 26, wherein said metal comprises aluminum.

28. An air conditioning system for an automotive vehicle, comprising:

a compressor;

means for driving the compressor from the engine of the automotive vehicle; and an evaporator connected to said compressor, said evaporator comprising an evaporator as defined by claim 1.

* * * * *